US006200722B1

(12) United States Patent
Fields et al.

(10) Patent No.: US 6,200,722 B1
(45) Date of Patent: Mar. 13, 2001

(54) METHOD OF MAKING AN ELECTROPHOTOGRAPHIC TONER SURFACE TREATED WITH METAL OXIDE

(76) Inventors: Robert D. Fields, 20 The Highlands, Rochester, NY (US) 14622; Satyanarayan A. Srinivaan, 102 Suburban Ct., Rochester, NY (US) 14620

( * ) Notice: Subject to any disclaimer, the term of this patent is extended or adjusted under 35 U.S.C. 154(b) by 0 days.

(21) Appl. No.: 09/450,606

(22) Filed: Nov. 30, 1999

(51) Int. Cl.[7] ..... G03G 9/083
(52) U.S. Cl. ..... 430/137; 430/106.6; 430/110
(58) Field of Search ..... 430/106.6, 110, 430/137

(56) References Cited

U.S. PATENT DOCUMENTS

| | | | | |
|---|---|---|---|---|
| 4,513,074 | | 4/1985 | Nash et al. | 430/106.6 |
| 4,546,060 | | 10/1985 | Miskinis et al. | 430/105 |
| 4,623,605 | | 11/1986 | Kato et al. | 430/110 |
| 4,933,251 | | 6/1990 | Ichimura et al. | 430/109 |
| 5,212,037 | | 5/1993 | Julien et al. | 430/120 |
| 5,272,040 | | 12/1993 | Nakasawa et al. | 430/110 |
| 5,350,657 | * | 9/1994 | Anno et al. | 430/111 |
| 6,010,814 | | 1/2000 | Kotsugai et al. | 430/110 |

OTHER PUBLICATIONS

Schinichi Sata, et al. Study on the Surface Properties of Polyester Color Toner, IS&T NIP 13, 149–152 (1997).

Nash, R. and Muller, R.N. "The Effect of Toner and Carrier Composition on the Relationship Between Toner Charge to Mass Ratio and Toner Concentration", IS&T NIP 13, 112–120, (1997).

* cited by examiner

*Primary Examiner*—John Goodrow

(57) ABSTRACT

A process for making an electrophotographic toner comprising:

(a) uniformly mixing a metal oxide selected from titanium dioxide and silicon dioxide with toner particles to form a mixture having 5 to 15 weight percent metal oxide;

(b) mixing the product of step (a) with additional toner particles at a mixing intensity ≧500,000 (cm/minute) minute;

wherein in the mixed product of (b) the metal oxide is 0.1 to 5.0 weight percent of the mixed product; and the toner particles have on their surfaces a metal oxide concentration in a ratio of 1.0–3.0:1.0 with respect to titanium dioxide on the surface of the toner particles:total titanium dioxide in the mixed product; and a ratio of 10.0–25.0:1.0 with respect to silicon dioxide on the surface of the toner particles:total silicon dioxide in the mixed product.

20 Claims, No Drawings

METHOD OF MAKING AN ELECTROPHOTOGRAPHIC TONER SURFACE TREATED WITH METAL OXIDE

RELATED APPLICATIONS

U.S. patent Ser. No. 09/452,087, pending filed on even date herewith entitled "Electrophotographic Toner Surface Treated with Metal Oxides", is a related application.

FIELD OF THE INVENTION

The present invention relates to electrophotographic imaging and in particular to a formulation and method for making electrophotographic toner materials surface treated with metal oxides.

BACKGROUND OF THE INVENTION

Digital electrophotographic printing products are being developed for printing high quality text and half tone images. Thus, there is a need to formulate electrophotographic toners and developers that have improved image quality. Surface treatment of toners with fine metal oxide powders, such as fumed silica or titania, results in toner and developer formulations that have improved powder flow properties and reproduce text and half tone dots more uniformly without character voids. See, for example, Schinichi Sata, et al. Study On The Surface Properties Of Polyester Color Toner, IS&T NIP13, 149–152 (1997). The improved powder fluidity of the toner or developer can, however, create unwanted print density in white image areas.

The triboelectric charging level of electrophotographic developers is known to change as prints are made. See, Nash, R. and Muller, R. N. "*The effect of Toner and Carrier Composition on the Relationship between Toner Charge to Mass Ratio and Toner Concentration*," IS&T NIP 13, 112–120, (1997). This instability in charging level is one of the factors that require active process control systems in electrophotographic printers in order to maintain consistent image density from print to print. Toners with a low triboelectric charge level produce prints with high reflection optical density; toners with a high triboelectric charge level produce prints with a low reflection optical density. A toner with a constant triboelectric charge level would consistently produce prints with the same reflection optical density.

What is needed in the art are toners with more stable triboelectric charge levels which decrease the incidence of dusting (defined below).

SUMMARY OF THE INVENTION

The present invention describes a method of using metal oxides to surface-treat toner particles thereby making toners with more stable triboelectric charge. These toners form less low-charge toner dust and image background, and produce images with fewer image voids. The present invention describes a method to apply the metal oxide to the toner surface. Formulations for surface treated toners have been described in U.S. Pat. Nos. 5,272,040; 4,513,074; 4,623,605; and 4,933,251, but there is no teaching that a process of applying the surface treatment could cause embedment of metal oxide particles below the surface of the toner particles and affect the performance of the toner. Toners made by the process described herein have lower levels of voids in printed characters and a lower background level in the non image areas of the print. "Character voids" are image defects where a complete letter character is not formed, there are areas where toner has not been deposited resulting in white spots in the character. "Background" is a image defect where toner is deposited in the white portion of a print, causing the print to look less sharp and white print areas to look slightly gray.

The present invention also discloses that the atomic percent of elemental metal in the metal oxide on the toner particle surface:the total weight percent of metal oxide in the toner formulation (herein referred to as "bulk metal oxide") affects the triboelectric properties and imaging characteristics of the toner. The present invention also discloses that within this preferred ratio range, toner fluidity and image quality are improved. The examples of the present invention demonstrate that there is a preferred concentration range for metal oxide on the surface of the toner particles and that toners falling within the preferred range provide the best image quality. The concentration of metal oxide on the surface of the toner particle is controlled by the process used in mixing and blending the toner particles with the fine metal oxide powder.

Hence, the present invention discloses a process for making an electrophotographic toner comprising:

(a) uniformly mixing a metal oxide selected from titanium dioxide and silicon dioxide with toner particles to form a mixture having 5 to 15 weight percent metal oxide; preferably 8 to 12 weight percent metal oxide;

(b) mixing the product of step (a) with additional toner particles at a mixing intensity $\geqq$500,000 (cm/minute) minute;

wherein in the mixed product of (b) the metal oxide is 0.1 to 5.0 weight percent of the mixed product; and the toner particles have on their surfaces a metal oxide concentration in a ratio of 1.0–3.0:1.0 with respect to titanium dioxide on the surface of the toner particles:total titanium dioxide in the mixed product; and a ratio of 10.0–25.0:1.0 with respect to silicon dioxide on the surface of the toner particles:total silicon dioxide in the mixed product.

The present invention provides a method for making toners that produce images having a low level of character voids and reduced background levels in the white image areas. Further, replenishment toners create lower levels of airborne toner particles when mixed with developers, resulting in cleaner printer operation.

DETAILED DESCRIPTION OF THE INVENTION

"Dusting characteristics" as used herein, refers to the amounts of uncharged or low charged particles that are produced when fresh replenishment toner is mixed in with aged developer. Developers in a two component electrophotographic developer system are a mixture of electrostatically charged carrier particles and oppositely charged toner particles. Developers that result in very low dust levels are desirable. Toner dust results from uncharged or low charge toner particles. This dust can be deposited in the non-image area of a paper print resulting in unwanted background. In a printer, replenishment toner is added to the developer station to replace toner that is removed in the process of printing copies. This added fresh toner is uncharged and gains a triboelectric charge by mixing with the developer. During this mixing process uncharged or low charged particles can become airborne and result in background on prints or dust contamination within the printer. A "dusting test" is described herein below to evaluate the potential for a replenishment toner to form background or dust.

"Low charge characteristics" as used herein refers to the ratio of charge to mass of the toner in a developer. Low charged toners are easier to transport through the electrostatographic process, for example from the developer station to the photoconductor, from the photoconductor onto paper, etc. Low charge is particularly important in multi-layer transfer processes in color printers, in order to minimize the voltage above already transferred layers as this maximizes the ability to transfer subsequent layers of toner. However, typically low charge toners also result in significant dust owing to the low charge. Toner dust is uncharged or low-charged toner particles that are produced when fresh replenishment toner is mixed in with aged developer. Developers that result in very low dust levels are desirable. Typically toners that exhibit high charge to mass ratios exhibit low levels of dust, and vice-versa. Toners that exhibit low charge to mass ratios and low dust characteristics are thus desirable.

"Bulk metal oxide" as used herein refers to the amount of silicon dioxide and/or titanium dioxide in the toner formulation, typically 0.1 to 5.0 weight percent, preferably 0.1 to 2.0 and most preferably to 0.15 to 0.35.

TABLE 1

Toner Formulation

| Component | Parts by weight | Supplier |
|---|---|---|
| styrene acylic copolymer CAS # 60806-47-5 | 100 | Eastman Kodak |
| Regal 300 Carbon Black CAS # 1333-86-4 | 7 | Cabot Corporation |
| T77 Charge Control Agent Organo iron chelate CAS # 115706-73-5 | 1.5 | Hodagaya |

The components were powder blended, melt compounded, ground in an air jet mill, and classified by particle size to remove fine particles (particles less than 5 microns ion diameter). The resulting toner had a median volume diameter particle size of 11.5 microns.

Surface Treatment of Toner to Form Concentrate

Toner can be surface treated by powder blending non surface treated toner and a metal oxide concentrate consisting of about 10 weight % metal oxide and 90 weight % toner in a high-energy Henschel mixer. Concentrates were made from: 1800 gm toner and 200 gm silicon dioxide or titanium dioxide, and mixed in a 10 liter Henschel mixer with a 6 element, 20 cm diameter mixing blade. The toner/silicon dioxide concentrates were mixed for 6 minutes at a mixing blade speed of 700 RPM and then an additional 6 minutes at a mixing speed of 2000 RPM. The toner/titanium dioxide concentrates were made by mixing for 12 minutes at 700 RPM.

The degree of mixing intensity has been found to affect the concentration level of metal oxide on the toner particle surface. Scanning electron micrographs (SEM's) and XPS analysis of the particle surface showed that high energy intensity mixing (defined below) resulted in embedment of the metal oxide in the toner particle surface and a resulting decrease in the surface concentration of metal oxide. High intensity mixing that embeds the surface treatment particles was found to be especially important for toners surface treated with titanium dioxide. The factor that can be used to measure the percentage of metal oxide on the surface of the toner particle is the atomic % metal oxide as measured by EXPS/the bulk metal oxide concentration determined from the weight % of metal oxide added to the toner formulation.

Fumed inorganic oxides used for toner surface treatment in the examples were:

TABLE 2

Inorganic Oxide Surface Treatments

| Inorganic Oxide | Trade Name | Supplier |
|---|---|---|
| Silica | HDK 1303CAS# | Wacker Chemie |
| Titania | T805CAS# | Degussa AG |

EXAMPLE USING TITANIUM DIOXIDE (SEE TABLE 5)

An electrophotographic toner formulation was surface treated with titanium dioxide. The titanium dioxide was a fumed titanium dioxide with a primary particle size less than 50 nm, a commercially available form sold as T805 by Degussa Corporation. The surface treated toner was made by powder mixing titanium dioxide and toner at low intensity to form a homogeneous concentrate of 10 weight % titanium and 90 weight % toner particles. The titanium dioxide/toner concentrate was made by mixing the powders in a 10 liter Henschel mixer with a 6 element, 20 cm diameter mixing blade for 12 minutes at 700 RPM. This concentrate was then mixed at high intensity with non surface treated toner to embed the titanium dioxide particles into the toner to produce a product that contains 0.1 to 0.5% by weight titanium dioxide and 99.9% to 99.5% by weight toner particles.

The concentration of titanium dioxide particles that were exposed on the toner surface were measured by x-ray photoelectron spectroscopy. This measurement is expressed as the atomic % of elemental titanium atoms/the total atomic percent of atoms detected on the toner surface which includes elemental titanium silicon, carbon and oxygen. The bulk titanium dioxide concentration was calculated by the weights of titanium dioxide and non surface treated toner that were used to make the titanium dioxide surface treated toner. From these two measurements, the ratio of titanium on the toner surface to the total titanium dioxide content of the surface treated toner could be calculated. The ratio of surface titanium dioxide (expressed as atomic % elemental titanium) to the total metal oxide in the toner composition (expressed as weight % of titanium dioxide in the toner composition) was in the range of 1.0 to 3.0:1.0.

Electrophotographic developers made from the toners of the invention had improved image quality characteristics (reduced background, a lower level of image character voids) compared to control toners that had no surface treatment and to surface treated toners that had higher (>3.0 atomic %/weight %) values for the ratio of surface titanium concentration/bulk titanium dioxide concentration. (Results in Table 9 below).

EXAMPLE USING SILICON DIOXIDE (SEE TABLE 4)

Silicon dioxide surface treated toner was prepared from 10 nm silicon dioxide manufactured by Wacher Chemie. Silicon dioxide-treated toner particles were prepared as described for titanium dioxide above except that the silicon dioxide/toner concentrate was mixed for 6 minutes at 700 RPM and then an additional 6 minutes at 2000 RPM. The silicon dioxide/toner concentrate was then mixed with additional non-surface treated toner to give a surface treated toner that had a silicon dioxide concentration of 0.15% (Tables 4 and 6). The ratio of surface silicon dioxide (expressed as atomic % elemental silicon dioxide) to the total metal oxide in the toner composition (expressed as weight % of silicon dioxide in the toner composition) was in the range of 10.0 to 25.0:1.0

EXAMPLES USING SILICON DIOXIDE AND TITANIUM DIOXIDE COMBINATION

To prepare toner surface treated with both silicon dioxide and titanium dioxide, toner concentrates were made as described above and then one of the following methods used. One method involved a single step (See examples 2, 3, 6, and 7,); the silicon dioxide and titanium dioxide concentrates were mixed with additional toner in a single mixing step to produce toner with a final concentration of 0.15 percent silicon dioxide and 0.35–0.5 percent titanium dioxide. (See, Table 3). Alternatively, a two-step method can be used; the titanium dioxide concentrate is mixed with untreated toner particles and then the silicon dioxide concentrate added and blended to make a final concentration of 0.15 percent silicon dioxide and 0.35–0.5 percent titanium dioxide. (See examples 4 and 5).

The energy intensity for powder mixing can be expressed by the factor mixing time multiplied by the mixing blade tip velocity.

Mixing energy intensity= where:

V=mixing blade tip velocity, cm/min t=mixing time, min

A value of mixing energy intensity greater than 1,000,000 is defined as high intensity mixing, a value less than 500,000 is defined as low intensity mixing.

This factor was computed for each toner example made and is listed in Table 3.

TABLE 3

Surface Treatment Mixing Conditions

| Example | Toner Weight, gm | Silicon dioxide Concentrate Weight | Titanium dioxide Concentrate Weight gm | Bulk Silicon dioxide, weight % of formulation | Bulk Titanium dioxide, Weight % of formulation | Mixing Step | Mixing Time minutes | Mixing Speed RPM | Mixing Intensity, (cm/min)min |
|---|---|---|---|---|---|---|---|---|---|
| Comparative Example 1 | No surface treatment | 0 | 0 | 0% | 0% | NONE | | | NA |
| Comparative Example 2 | 1900 | 30 | 70 | 0.15% | 0.35% | Step 1 | 2 | 2000 | 250900 |
| Comparative Example 3 | 1870 | 30 | 100 | 0.15% | 0.5% | Step 1 | 2 | 2000 | 250900 |
| 4 | 1900 | 0 | 70 | | | Step 1 | 15 | 3500 | 3297000 |
| | 30 | 0 | 0.15% | 0.35% | Step 2 | 2 | 2000 | 250900 | |
| 5 | 1870 | 0 | 100 | | | Step 1 | 15 | 3500 | 3297000 |
| | 30 | 0 | 0.15% | 0.5% | Step 2 | 2 | 2000 | 250900 | |
| 6 | 1900 | 30 | 70 | 0.15% | 0.35% | Step 1 | 2 | 2000 | 250900 |
| 7 | 1900 | 30 | 70 | 0.15% | 0.35% | Step 1 | 10 | 4600 | 2888800 |

TABLE 4

Toner Surface Treated with Silicon dioxide

| Example | Toner Weight, gm | 10% Silicon dioxide Concentrate Weight, gm | Bulk Silicon dioxide, weight % of formulation | Mixing Time minutes | Mixing Speed RPM | Mixing Intensity (cm/min)min |
|---|---|---|---|---|---|---|
| Comparative 8 | 1970 | 30 | 0.15 | 2 | 2000 | 250900 |
| 9 | 1970 | 30 | 0.15 | 10 | 3900 | 2888800 |

TABLE 5

Toner Surface Treated with Titanium dioxide

| Example | Toner Weight, gm | 10% Titanium dioxide Concentrate Weight, gm | Bulk Titanium dioxide, weight % of formulation | Mixing Time minutes | Mixing Speed RPM | Mixing Intensity $cm/min^2$ |
|---|---|---|---|---|---|---|
| Comparative 10 | 1930 | 70 | 0.35 | 2 | 2000 | 250900 |
| 11 | 1930 | 70 | 0.35 | 10 | 3900 | 2888800 |

TABLE 6

Triboelectric Charge Level, Toner Surface Treated with Silicon dioxide Only

| Example | Bulk Silicon dioxide Weight % | Surface Silicon dioxide, % Atomic Si | Surface/Bulk Silicon dioxide Ratio | 2 min. Q/m μC/gm Q/m | 10 min Q/m μC/gm Q/m | 60 min Q/m, Q/m |
|---|---|---|---|---|---|---|
| Comparative Example 1 | 0 | | | −14.9 | −18.6 | −21.2 |
| Comparative Example 8 | 0.15 | 2.98 | 19.9 | −14.9 | −21.5 | −21.5 |
| 9 | 0.15 | 1.58 | 10.5 | −17.2 | −21.2 | −21.4 |

TABLE 7

Triboelectric Charge Level, Toner Surface Treated with Titanium dioxide Only

| Example | Bulk Titanium dioxide, Weight % | Surface Titanium dioxide, % Atomic Ti | Surface/Bulk Titanium dioxide Ratio | 2 min. Q/m μC/gm Q/m | 10 min Q/m μC/gm Q/m | 60 min Q/m, gm Q/m |
|---|---|---|---|---|---|---|
| Comparative Example 1 | 0 | | | −14.9 | −18.6 | −21.2 |
| 10 | 0.35 | 1.44 | 4.11 | −8.8 | −12.5 | −18.1 |
| 11 | 0.35 | 0.88 | 2.5 | −12.7 | −13.6 | −18.4 |

Measurement of Toner Surface Composition—procedure for XPS Surface Analysis of toner powder samples.

The toner surface concentration of titania was measured as atomic titanium by x-ray photoelectron spectroscopy (XPS).

The sample holder used for a toner powder sample is a 12mm×10 mm×2 mm gold coated steel plate with a shallow circular hole in the center (6 mm in diameter and 1 mm in depth). The toner powder was placed in the circular area and analyzed.

The XPS spectrum was obtained using a Physical Electronics 5600CI photoelectron spectrometer with monochromatic A1 K X-rays (1486.6 eV). A 7 mm filament X-ray source was operated at 14 kV and 200 W to minimize the damage of the sample surface. Charge compensation for the insulating organic powders was achieved by flooding the sample surfaces with low energy electrons biased at 0.5 eV. Typical pressures in the test chamber during the measurements was $1\times10^{-9}$ Torr. All samples were stable under the X-ray radiation and showed no evidence of damage during each measurement (20–40 minutes).

The surface elemental compositions were obtained from the XPS survey scans, acquired at high sensitivity and low energy resolution (electron passing energy of 185.5 eV). The instrumentation error is 0.1–0.2 atomic %. All the XPS spectra were taken at an electron take-off angle of 45°, which is equivalent to a sampling depth of 50 Å.

The surface concentration of silicon or titanium was expressed as the atomic percent of elemental titanium or silicon dioxide based on the total elemental carbon, oxygen, silicon, and titanium.

Developer Formulation and Developer Charge Measurement

Electrophotographic developers were made by mixing toner with hard magnetic ferrite carrier particles as described in U.S. Pat. No. 4,546,060 to Jadwin and Miskinis. Developers were made at a concentration of 10 weight % toner, 90 weight % carrier particles. The developer was mixed on a device that simulated the mixing that occurs in a printer developer station to charge the toner particles. The triboelectric charge of the toner was then measured after 2, 10, and 60 minutes of mixing. See Table 3.

In a printer, replenishment toner is added to the developer station to replace toner that is removed in the process of printing copies. The replenishment toner is un-charged and gains a triboelectric charge by mixing with the developer. During this mixing process uncharged or low charged particles can become airborne and result in background on prints or dust contamination within the printer. Using the following method, a "dusting test" was done to evaluate the potential for a replenishment toner to form background or dust. A developer sample is exercised on a rotating shell and magnetic core developer station. After 10 minutes of exercising, uncharged replenishment toner is added to the developer. A fine filter over the developer station then captures airborne dust that is generated when the replenishment toner is added and the dust collected and weighed. The lower the value for this "dust" measurement the better the toner performance.

Table 8 tabulates the results of the triboelectric charge level and replenishment dust rate tests. Examples 4 and 5 were surface treated with titania and mixed intensively to give a lower surface titanium concentration than examples 2 and 3. Example 1 had no surface treatment. The initial (2' Q/m measurement) tribocharging level for Examples 4 and 5 was higher than samples that had higher surface titanium concentrations or non-surface treated toner. This characteristic of rapid charging is important to maintain consistent print quality. The replenishment toner dust rate values were the lowest for Examples 4 and 5 compared to 1, 2 or 3.

Tables 6 and 7 report triboelectric charge measurements for toner that were surface treated with silicon dioxide only or titanium dioxide only. The toner that was surface treated with silicon dioxide and intensively blended, Example 9, had a higher triboelectric charge level measured after mixing a developer for 2 minutes than the non-surface treated control toner, Example 1, or a silicon dioxide surface treated toner that was not intensively blended, comparative Example 8. The same effect was observed in Examples 10 and 11. This illustrates that mixing conditions surface treatment blending conditions do effect triboelectric charge levels.

TABLE 8

Comparison of Toner Charge Stability and Relative Dusting Rates

| | Bulk Titania, Weight % | Surface Titania, Ti atomic % | Surface/Bulk Titania Ratio | Bulk Silica, Weight % | Surface Silica, Si Atomic % | Surface/Bulk Silica Ratio | 2 min. Q/m μC/gm Q/m | 10 min Q/m μC/gm Q/m | 60 min Q/m, μC/gm Q/m | Replenishment Relative Dust Rate |
|---|---|---|---|---|---|---|---|---|---|---|
| Control Example 1 | No surface treatment | None | None | None | None | None | −14.9 | −18.6 | −21.2 | 7.2 |
| Comparative Example 2 One step | 0.35 | 1.30 | 3.7 | 0.15 | 3.37 | 22.7 | −12.6 | −16.8 | −21.6 | 12.6 |
| Comparative Example 3 One step | 0.5 | 1.96 | 3.3 | 0.15 | 3.44 | 22.9 | −10 | −15.6 | −19.1 | 24.2 |
| Example 4 Two steps | 0.35 | 0.85 | 2.4 | 0.15 | 3.63 | 24.2 | −16.1 | −18.7 | −21.1 | 2.3 |
| Example 5 Two steps | 0.5 | 1.08 | 2.2 | 0.15 | 3.38 | 22.5 | −15.6 | −17.6 | −20.4 | 2.2 |

Evaluation of Image Quality

Prints for image quality evaluation were made on a prototype electrophotographic printer. Ten to twenty thousand prints for each material set were made. The print image quality was evaluated for voids in text characters and background density in non-image areas of the print. Background was measured by the RMSGS method. For this measurement the lower the value, the lower background density image and the better the print. Character voids were measured by scanning characters and computing the log (% void area within characters). For this measurement the more negative the value, the fewer the voids, and the better the image.

The examples in Table 4 show that the surface treated toner examples (6 and 7) had fewer character voids than the control non-surface treated toner example, Comparative Example 1. Toner Example 7 was prepared by intensively mixing the titania surface treatment component with the toner and had half the background level as the same formulation that was not intensively mixed (Comparative Example 6)

TABLE 9

Comparison of Image Quality

| | Toner Surface Characterization | | | Image Quality Evaluation | |
|---|---|---|---|---|---|
| Example | Bulk Titania, wt. % TiO2 Column A | Surface Titania, As atomic % Ti Column B | Surface Ti/ Bulk TiO2 Column B/A | Text voids (more negative value = fewer character voids) | RMS GS Background (lower values = reduced background density |
| Comparative Example 1 | None | None | Not applicable | −1.83 | 0.78 |
| Comparative Example 6 | 0.35 | 1.39 | 3.97 | −2.08 | 0.70 |
| Example 7 | 0.35 | 0.69 | 1.97 | −2.12 | 0.35 |

What is claimed is:

1. A process for making an electrophotographic toner comprising:

(a) uniformly mixing at least one particulate metal oxide selected from titanium dioxide, silicon dioxide, and mixtures thereof with toner particles to form a mixture having 5 to 15 weight percent metal oxide; and (b) mixing the product of step (a) with additional toner particles at a mixing intensity ≧500,000 (cm/minute) minute sufficient to embed the at least one metal oxide particles into the toner particles and decrease the concentration of the at least one metal oxide on the surface of the toner particles;

wherein in the mixed product of (b) the metal oxide is 0.1 to 5.0 weight percent of the mixed product; and the toner particles have on their surfaces:when titanium dioxide is employed, a metal oxide concentration in a ratio of 1.0–3.0:1.0 with respect to titanium dioxide on the surface of the toner particles (determined in terms of atomic percent titanium based on total atomic elements present as measured by x-ray photoelectron spectroscopy):total bulk titanium dioxide in the mixed product; and when silicon dioxide is employed, a ratio of 10.0–25.0:1.0 with respect to silicon dioxide on the surface of the toner particles (determined in terms of atomic percent silicon based on total atomic elements present as measured by x-ray photoelectron spectroscopy):total bulk silicon dioxide in the mixed product.

2. The process of claim 1 wherein the metal oxide concentration in step (a) is 8 to 12 weight percent.

3. The process of claim 1 wherein the mixing intensity in step (b) is ≧1,000,000 and the metal oxide is titanium dioxide.

4. The process of claim 1 wherein the metal oxide in the mixed product of step (b) is 0.1 to 2.0 weight percent.

5. The process of claim 1 wherein the metal oxide in the mixed product of step (b) is 0.15 to 0.35 weight percent.

6. The process of claim 1 wherein the ratio of titanium dioxide on the surface of the toner particles:titanium dioxide in the mixed product of step (b) is 2.0–2.5:1.0.

7. The process of claim 1 wherein the ratio of silicon dioxide on the surface of the toner particles:total silicon dioxide in the mixed product of step (b) is 20.0–25.0:1.0.

8. A process of making an electrophotographic developer comprising process of claim 1 and the added step of adding magnetic ferrite carrier particles to the mixed product.

9. An electrophotographic developer as in claim 8 wherein the magnetic ferrite is iron strontium ferrite.

10. The process of claim 1 wherein the at least one metal oxide includes silicon dioxide and titanium dioxide.

11. A process for making an electrophotographic toner comprising uniformly mixing at least one metal oxide selected from titanium dioxide, silicon dioxide, and mixtures thereof with toner particles at a mixing intensity sufficient to embed the at least one metal oxide particles into the toner particles and decrease the concentration of the at least one metal oxide on the surface of the toner particles, said mixing thereby forming a metal oxide—toner mixture, the metal oxide—toner mixture having a bulk metal oxide content of from 0.1 to 5.0 weight percent of the total mixture; and the toner particles have on their surfaces, when titanium dioxide is employed, a metal oxide concentration in a ratio of 1.0–3.0:1.0 with respect to titanium dioxide on the surface of the toner particles (determined in terms of atomic percent titanium based on total atomic elements present as measured by x-ray photoelectron spectroscopy):total bulk titanium dioxide in the mixture; and, when silicon dioxide is employed, a ratio of 10.0–25.0:1.0 with respect to silicon dioxide on the surface of the toner particles (determined in terms of atomic percent silicon based on total atomic elements present as measured by x-ray photoelectron spectroscopy):total bulk silicon dioxide in the mixture.

12. The process of claim 11 wherein the mixing intensity is greater than or equal to 500,000.

13. The process of claim 11 wherein the mixing intensity is greater than or equal to 1,000,000.

14. The process of claim 11 wherein the metal oxide content in the metal oxide—toner mixture is 0.1 to 2.0 weight percent.

15. The process of claim 11 wherein the metal oxide content in the metal oxide—toner mixture is 0.15 to 0.35 weight percent.

16. The process of claim 11 wherein the ratio of titanium dioxide on the surface of the toner particles:titanium dioxide in the mixture is 2.0–2.5:1.0.

17. The process of claim 11 wherein the ratio of silicon dioxide on the surface of the toner particles:total silicon dioxide in the mixture is 20.0–25.0:1.0.

18. A process of making an electrophotographic developer comprising process of claim 11 and the added step of adding magnetic ferrite carrier particles to the metal oxide—toner mixture.

19. An electrophotographic developer as in claim 18 wherein the magnetic ferrite is iron strontium ferrite.

20. A process for making an electrophotographic toner comprising:

(a) uniformly mixing at least one metal oxide selected from titanium dioxide, silicon dioxide and mixtures thereof with toner particles to form a mixture having 8 to 12 weight percent metal oxide; and (b) mixing the product of step (a) with additional toner particles at a mixing intensity of greater then or equal to 1,000,000 (cm/minute) minute;

wherein in the mixed product of (b) the metal oxide is 0.1 to 0.5 weight percent of the mixed product; and the toner particles have on their surfaces: when titanium dioxide is employed, a metal oxide concentration in a ratio of 1.0–3.0:1.0 with respect to titanium dioxide on the surface of the toner particles (determined in terms of atomic percent titanium based on total atomic elements present as measured by x-ray photoelectron spectroscopy):total bulk titanium dioxide in the mixed product; and when silicon dioxide is employed, a ratio of 10.0–25.0:1.0 with respect to silicon dioxide on the surface of the toner particles (determined in terms of atomic percent silicon based on total atomic elements present as measured by x-ray photoelectron spectroscopy):total bulk silicon dioxide in the mixed product.

* * * * *